US007010249B2

(12) United States Patent
Hattori

(10) Patent No.: US 7,010,249 B2
(45) Date of Patent: Mar. 7, 2006

(54) TONER AGITATING DEVICE AND TONER CONVEYING DEVICE FOR AN IMAGE FORMING APPARATUS

(75) Inventor: Yoshio Hattori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 103 days.

(21) Appl. No.: 10/726,665

(22) Filed: Dec. 4, 2003

(65) Prior Publication Data

US 2004/0165913 A1 Aug. 26, 2004

(30) Foreign Application Priority Data

Dec. 13, 2002 (JP) ..... 2002-362539

(51) Int. Cl.
*G03G 15/08* (2006.01)

(52) U.S. Cl. ..... 399/253; 399/258

(58) Field of Classification Search ..... 399/107, 399/119, 222, 252, 253, 254, 255, 258, 262
See application file for complete search history.

(56) References Cited

U.S. PATENT DOCUMENTS

| | | | | |
|---|---|---|---|---|
| 6,393,241 | B1 | 5/2002 | Matsumoto et al. | |
| 6,501,913 | B1 | 12/2002 | Hattori et al. | |
| 6,507,720 | B1 | 1/2003 | Kabumoto et al. | |
| 6,507,723 | B1 * | 1/2003 | Zalewski | 399/292 |
| 6,567,637 | B1 | 5/2003 | Yanagisawa et al. | |
| 6,567,643 | B1 | 5/2003 | Yasui et al. | |
| 6,591,077 | B1 | 7/2003 | Yanagisawa et al. | |
| 6,608,981 | B1 | 8/2003 | Mae | |
| 6,628,908 | B1 | 9/2003 | Matsumoto et al. | |
| 6,665,508 | B1 | 12/2003 | Sudo et al. | |
| 6,693,654 | B1 | 2/2004 | Shinohara | |

FOREIGN PATENT DOCUMENTS

| | | |
|---|---|---|
| JP | 2000-137376 | 5/2000 |
| JP | 2000-227706 | 8/2000 |
| JP | 2000-351445 | 12/2000 |
| JP | 2002-278242 | * 9/2002 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A toner agitating device feeds air from an air feeding device to the inside of a toner container storing powdery toner therein to thereby agitate the toner. The air feeding device is implemented by at least one variable air pump capable of varying the amount of air to be fed for a unit time.

12 Claims, 5 Drawing Sheets

TONER AGITATING DEVICE AND TONER CONVEYING DEVICE FOR AN IMAGE FORMING APPARATUS

BACKGROUND OF THE INVENTION

1. Field of the Invention

The present invention relates to an electrophotographic image forming apparatus and more particularly to a toner agitating device and a toner conveying device for use in a printer, facsimile apparatus, copier or similar electrophotographic image forming apparatus of the type using a single-component type developer.

2. Description of the Background Art

It is a common practice with an image forming apparatus of the type described to use a hard bottle as a toner container for storing dry toner or carrier or a mixture thereof (represented by toner hereinafter), which constitutes a developer. For example, a toner cartridge, which is a specific form of a hard bottle, may be provided with an agitator or toner agitating and discharging means therein. Alternatively, a spiral groove may be formed on the inner periphery of the toner cartridge, so that toner can be moved and discharged when the toner cartridge is rotated. Further, the toner cartridge may not be provided with any toner discharging mechanism, in which case toner is discharged by manual operation.

Today, in parallel with the trend toward the reduction of wastes for coping with environmental problems, there is an increasing demand for the collection and recycling of toner containers. While a soft, foldable container, which has been proposed in various forms in the past, is an implementation that meets the above demand, dry toner for electrophotography generally lacks fluidity and is apt to cohere and therefore cannot be easily discharged from a soft container. More specifically, it is difficult to arrange in a soft container rigid members for supporting mechanical parts that agitate and discharge the above toner, i.e., an agitator and a discharging mechanism. Further, the discharging mechanism obstructs the reduction of the volume of the soft container. Even if the soft container is operated by hand for discharging the toner, the soft container is not easy to handle.

In light of the above, there has been proposed a system that feeds air to the inside of a flexible container for thereby agitating and fluidizing toner stored in the container and sucks the toner out of the container with a powder pump, i.e., single-axis eccentric screw pump. Japanese Patent Laid-Open Publication No. 2000-351445, for example, proposes to use an air pump as means for feeding air to the inside of a soft container for the above purpose. As for agitation using air, however, it is necessary to give consideration to the amount of air to be fed that varies in accordance with the amount of toner remaining in the container; the former increases with an increase in the latter or decreases with a decrease in the latter.

It has been customary to feed air at a constant flow rate with a single air pump without regard to the amount of toner remaining in a soft container. This brings about a problem that when the amount of toner remaining in a soft container is great, the amount of air is apt to be short and fail to sufficiently agitate the toner, resulting in defective toner replenishment, i.e., causing much toner to remain in the container. On the other hand, when the amount of toner remaining in the container is small, it is likely that the bulk density of the toner and therefore the amount of replenishment decreases, lowering image density.

Japanese Patent Laid-Open Publication Nos. 11-282236 and 2000-351445, for example, each disclose a powder conveying device of the type replenishing toner from a bag-like or soft toner container by with a suction type powder pump. Further, Japanese Patent Laid-Open Publication Nos. 2000-137376 and2000-227706, for example, each propose to combine an air pump and a powder pump generally referred to as a Mono pump. However, such prior art schemes all feed air without regard to the amount of toner remaining in a toner container.

While Japanese Published Patent No. 10-500610, for example, teaches a liquid discharging container with a refilling container relating to a mechanism for opening and closing the cap of a toner container, it is not a solution to the problems stated above.

SUMMARY OF THE INVENTION

It is an object of the present invention to provide a toner agitating device capable of agitating and fluidizing powdery toner stored in a soft, foldable container by feeding air from air feeding means.

It is another object of the present invention to provide a toner conveying device capable of efficiently conveying toner, which is agitated by the above toner agitating device, in accordance with the amount of toner remaining in the toner container.

It is a further object of the present invention to provide an electrophotographic image forming apparatus configured to replenish toner to a developing device with the above toner conveying device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
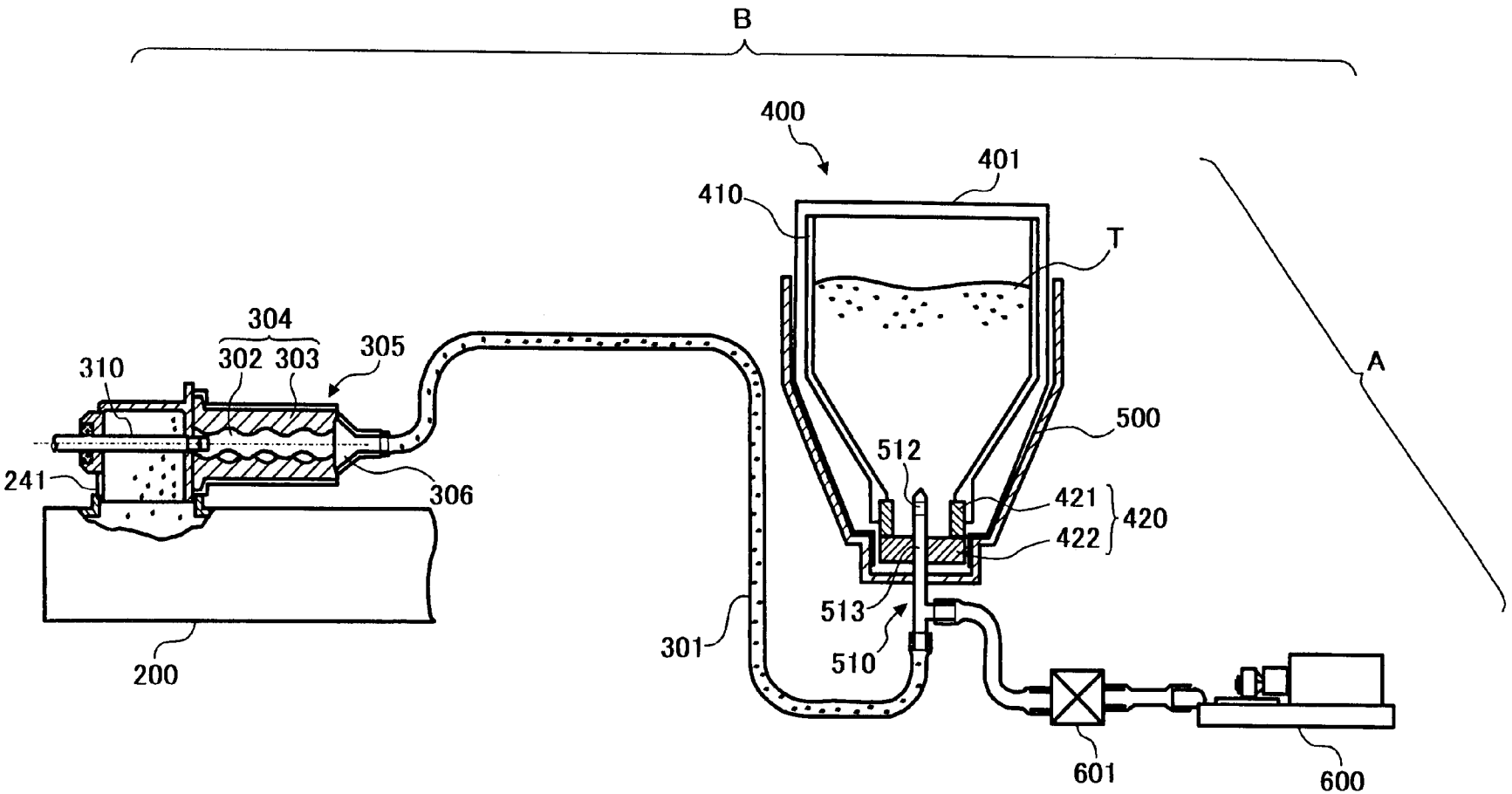
FIG. 1 is a view showing a toner agitating device embodying the present invention and a toner conveying device including the same.
Figure 2A:
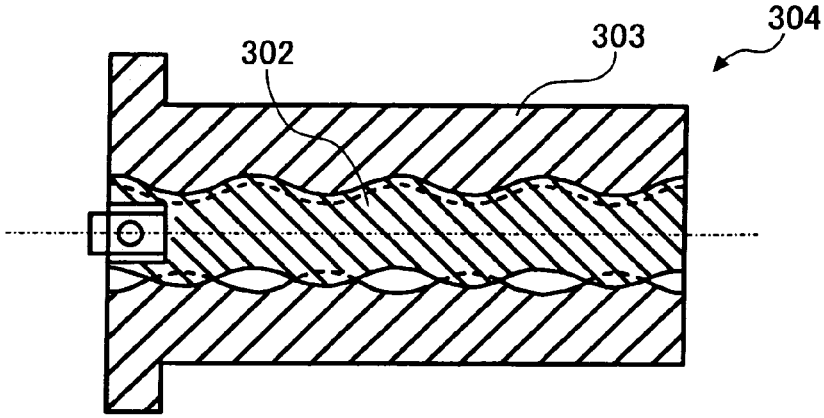
FIGS. 2A through 2C are views showing the configuration of a powder pump included in the illustrative embodiment.
Figure 2B:
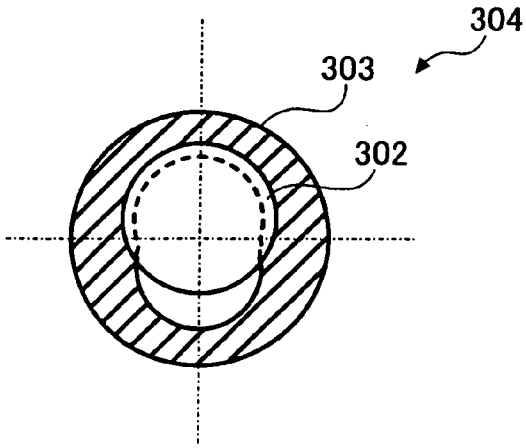
Figure 2C:
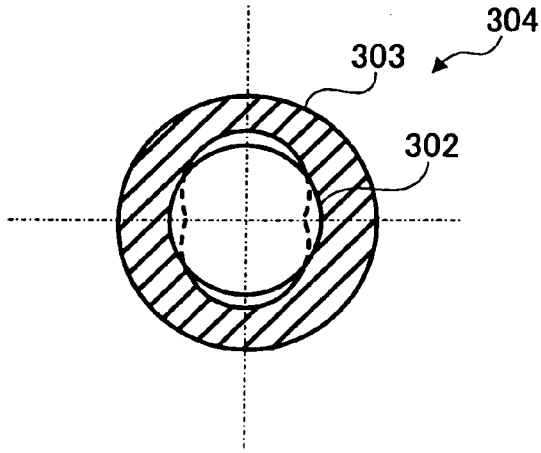

Referring to FIG. 1 of the drawings, a toner agitating device A and a toner conveying device B embodying the present invention are shown. As shown, a developing device 200, configured to develop a latent image formed on a drum (not shown) includes a powder pump 304. The powder pump 304 replenishes toner to the developing device 200.

The powder pump 304 is implemented as, e.g., a suction type, single-axis eccentric screw pump generally referred to as a Mono pump. As shown in FIGS. 1 and 2A through 2C, the Mono pump is made up of a rotor 302, a stator 303, and a holder 305. The rotor 302 is formed of metal or similar rigid material and configured as an eccentric screw. The stator 303, which is stationary and surrounds the rotor 302, is formed of rubber and has its inner periphery implemented as two screws. The holder 305, surrounding the stator 303, is formed of, e.g., resin and forms a powder passage. When a motor, not shown, causes the rotor 302 to rotate, a strong sucking force is generated in the pump 304 and sucks powdery toner T out of a toner container 400, which is communicated to the pump 304 by a flexible tube 301. More specifically, a toner inlet 306 is positioned at the upstream end of the holder 305 and communicated to a toner passage formed in the stator 303. The tube 301 is connected to the toner inlet 306 at one end and connected to the toner outlet of the toner container 400 at the other end.

The powder pump 304 and tube 301 constitute the toner conveying device B in combination.

The toner T stored in the toner container 400 is conveyed to the developing device 200 via the tube 301 by gravity and the suction of the powder pump 304. The problem with the toner T for use in the electrophotographic developing device 200 is that its fluidity is low. Therefore, when part of the toner T around a nozzle 510 is sucked out of the toner container 400 by the powder pump 304, a void is apt to appear in the toner container 400 around the nozzle 510, i.e., bridging is apt to occur. Such bridging or similar undesirable occurrence ascribable to defective agitation makes the amount of toner replenishment unstable or causes the toner T to remain in the toner container 400 in an extremely great amount.

In light of the above, in the illustrative embodiment, air feeding means 600, implemented by an air pump by way of example, feeds air to the toner container 400 via an electromagnetic valve 601 and the nozzle 510. The electromagnetic valve 601 is capable of not only selectively controlling air feed ON or OFF, but also controlling the amount of air for a unit time, i.e., the flow rate of air.

The air feeding means 600, valve 601 and toner container 400 constitute the toner agitating device A. It should be noted that the valve 601 of the toner agitating device A and the powder pump 304 of the toner conveying device B are not driven at the same time; otherwise, air would mostly be fed to the pump 304 and would therefore fail to sufficiently agitate the toner T in the toner container 400.

In the illustrative embodiment, the toner conveying device B is driven and controlled by a conventional toner content sensing and controlling system. More specifically, a permeability sensor (not shown) is mounted on part of the developing device 200 so as to sense the toner content of a developer existing in the developing device 200. If the toner content is short, as determined by the permeability sensor, a motor (not shown) drives the powder pump 304 via a drive shaft 310. Subsequently, when the amount of toner T replenished to the developing device 200 reaches a preselected amount, the above motor and therefore powder pump 304 is caused to stop operating in response to the resulting output of the permeability sensor. Of course, the toner content sensing and controlling system is only illustrative and may be replaced with any other conventional system, e.g., a system that controls the amount of toner replenishment by sensing the reflection density of a toner image formed on a photoconductive element.

The tube 301 is provided with an inside diameter of 4 mm to 10 mm and should preferably be formed of polyurethane, nitril, EPDM (Ethylene-Propylene-Diene Terpolymer), silicone or similar rubber material or polyethylene, nylon or similar plastic material that is flexible and highly resistant to toner.

The toner container 400 is made up of a holder 500, a protective casing 401 accommodated in the holder 500, and a bag 410 disposed in the protecting casing 401 and storing the toner T. The holder 500 supports the protective casing 401 and is formed of, e.g., resin. The protective casing 401 is formed of, e.g., corrugated cardboard or plastics and configured to surround the bag 410. Part of the protective casing 401 is connected to a mouth member 420. The bag 410 is implemented by a flexible sheet of, e.g., polyethylene, nylon or similar resin or Japanese paper or a laminate of such flexible sheets folded by a paper folding technology and has a hermetically closed structure having no air inlets or air outlets. The bag 410 is 80 $\mu$m to 200 $\mu$m thick or so.

The mouth member 420, forming part of the bag 410, is made up of a case 421 formed of, e.g., polyethylene, nylon or similar resin and a seal member 422. The case 421 and seal member 422 should preferably be formed of the same material as the bag 410 from the recycling standpoint and can be easily fitted to the bag 410 if done so.

Figure 3A:
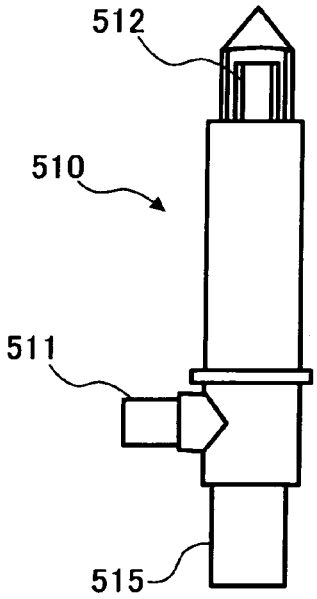
FIGS. 3A and 3B show a specific configuration of a nozzle included in the illustrative embodiment.
Figure 3B:
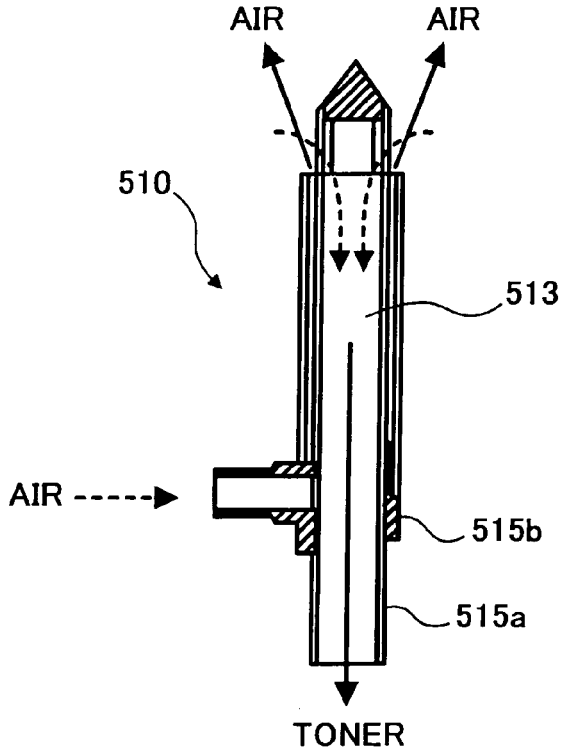
Figure 4A:
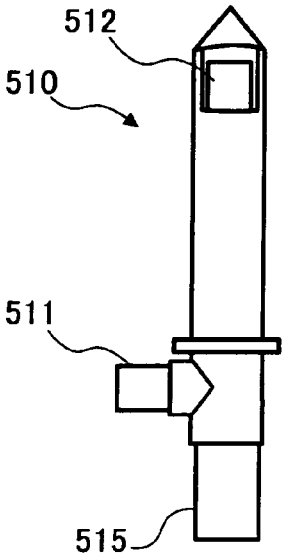
FIGS. 4A and 4B show another specific configuration of the nozzle.
Figure 4B:
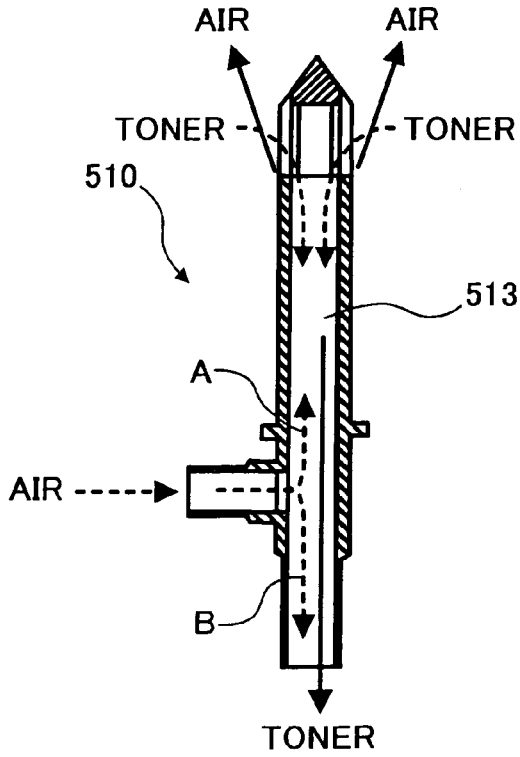

The nozzle 510 is formed integrally with or removably connected to the holder 500. As shown in FIG. 3A, the nozzle 510 includes an air passage 511 joining a toner passage 515. As shown in FIG. 3B, the nozzle 510 may be provided with a double-wall structure including an inside tube 515*a* and an outside tube 515*b* spaced from each other by an annular gap which is communicated to the air passage 515; a space inside the inside tube 515*a* serves as a toner passage. Alternatively, as shown in FIGS. 4A and 4B, the nozzle 510 may be provided with a single tube structure and is applied to the toner agitating device A, FIG. 1, because of low cost.

When the toner container 400 is mounted to the holder 500, the sharp tip of the nozzle 510, formed with an opening 512, penetrates the seal member 422 into the toner container 400. More specifically, the seal member 422 is a flexible member having preselected thickness and formed of, e.g., foam sponge or rubber and is formed with a cruciform slit. When the tip of the nozzle 510 is inserted into the slit of the seal member 422, the seal member 422 closely contacts the outer surface of the nozzle 510, preventing the toner T from leaking to the outside of the bag 410. Also, when the toner container 400 is removed from the holder 500, the slit of the seal member 522 automatically closes because of its elasticity, obviating the leakage of the toner T. The length of the slit is equal to the outside diameter of the tip of the nozzle 510 or greater than the same by up to about 3 mm. The seal member 422 and case 421 are connected together by, e.g., a two-sided adhesive tape. The seal member 422, formed of the elastic material mentioned above, is highly resistant to toner, allows a minimum of air to pass therethrough, and has strength free from creep.

The toner T, sucked from the toner container 400 by the powder pump 304, is caused to drop into the developing device 200 via a toner inlet 241 and is then conveyed to a developing section by a screw (not shown). When use is made of a toner and carrier mixture, i.e., a two-component type developer, the toner thus replenished to the developing device 200 is mixed with a developer existing in the developing device 200 while being agitated and is therefore controlled to an adequate toner content and an adequate amount of charge.

Figure 5:
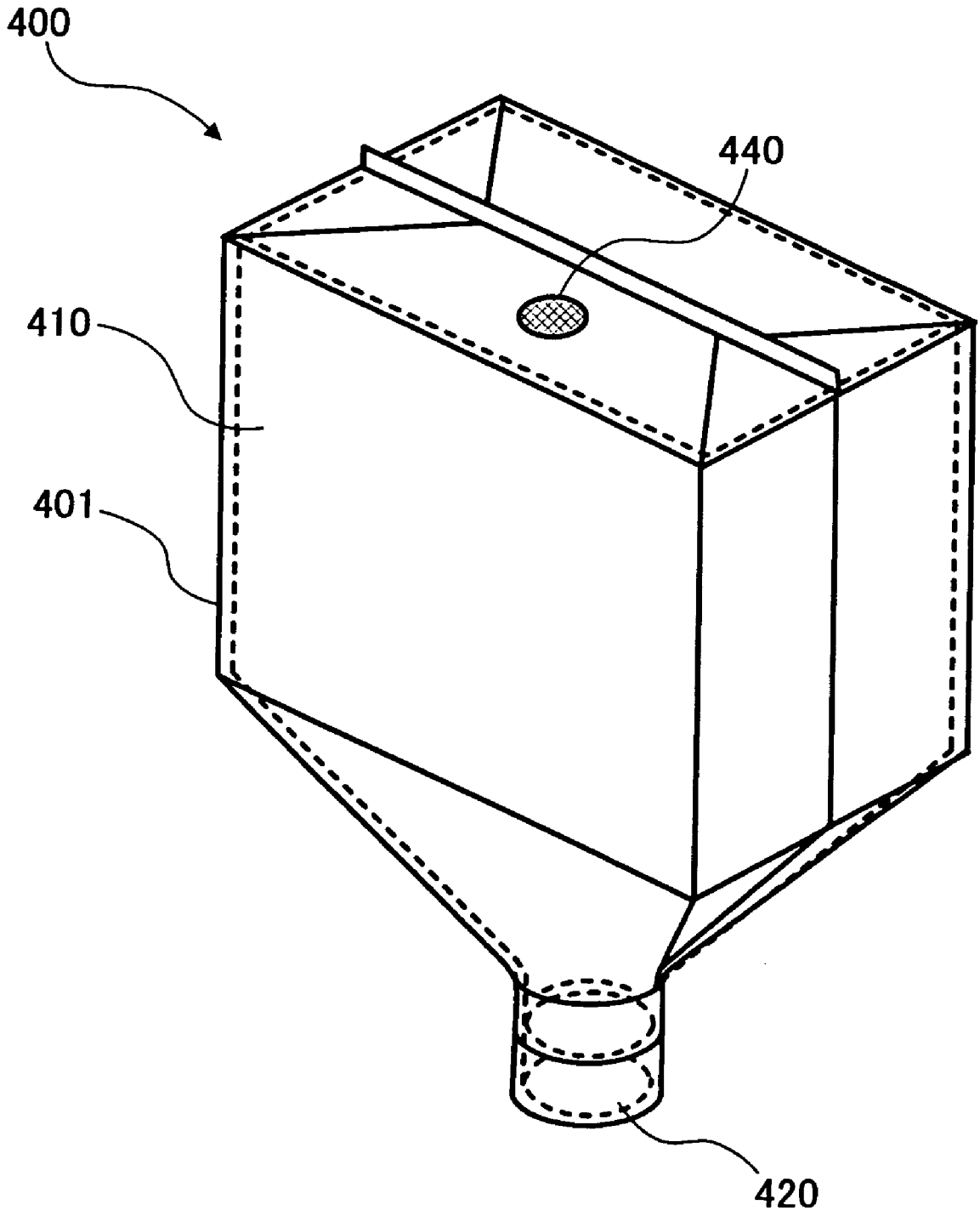
FIG. 5 is a perspective view showing a specific configuration of a toner container.

As shown in FIG. 5, an air-permeable filter 440 may be positioned on the top of the toner bag or toner storing member 410 so as to depressurize the inside of the bag 410 to positive pressure by use of air fed from the air feeding means 600, FIG. 1. More specifically, the sucking force of the powder pump 304, FIG. 1, is weaker than the output of the air feeding means 600, so that pressure inside the bag 410 is apt to rise during usual drive. The rise of pressure, however, is likely to render the amount of toner replenishment irregular, causing the toner T to be replenished in an excessive amount. With the filter 440, it is possible to control pressure inside the bag 410 substantially to the atmospheric pressure and therefore to obviate the excessive toner replenishment.

The protective case 401 is rigid and therefore allows the toner container 400 to be easily handled when being mounted to or dismounted from the holder 500 of the toner agitating device A or the toner conveying device B. Further, the protective case 401 is effective to maintain the quality of the toner T present in the toner container 400 constant.

The mouth member 420 and toner container 400 may be formed integrally with each other by, e.g., blow molding, constituting a flexible toner container, if desired.

After the toner container 400 has run out of the toner T and is dismounted from the holder 500, the protective case 401 and bag 410 can be easily separated from each other. In addition, the protective case 401 can be folded down. Further, the bag 410, which is flexible, occupies a far smaller space than the conventional cartridge, bottle or similar hard bottle and is therefore easy to handle in the event of transport or storage, noticeably reducing cost necessary for collection from the user's station by the manufacturer.

While the toner container 400 has been shown and described as being a soft container whose volume is reducible, it may alternatively be formed of a hard material, if desired.

In the illustrative embodiment, the amount of toner T remaining in the toner container 400 is determined by a real-time decision on the basis of the total amount of toner T conveyed by the toner conveying device B. A contror (not shown) controls the air pump and powder pump in accordance with the above amount determined. To determine the total amount of toner conveyed by the conveying device B or consumed, use may be made of a write pixel counter customarily included in a digital image forming apparatus. Alternatively, the amount of toner remaining in the toner container 400 may be determined by eye or by a photosensor.

In the illustrative embodiment, the flexible tube 301 should only be connected to the developing device 200 included in an electrophotographic image forming apparatus. This, coupled with the fact that the toner replenishing device can be freely positioned relative to the developing device, makes it possible for the user to locate the toner replenishing device at a position where the toner container 400 can be most easily replaced. For this reason, the illustrative embodiment is particularly effective when applied to a color copier or a color printer of the type including a plurality of, e.g., four toner replenishing devices, as will be described hereinafter.

Figure 6:
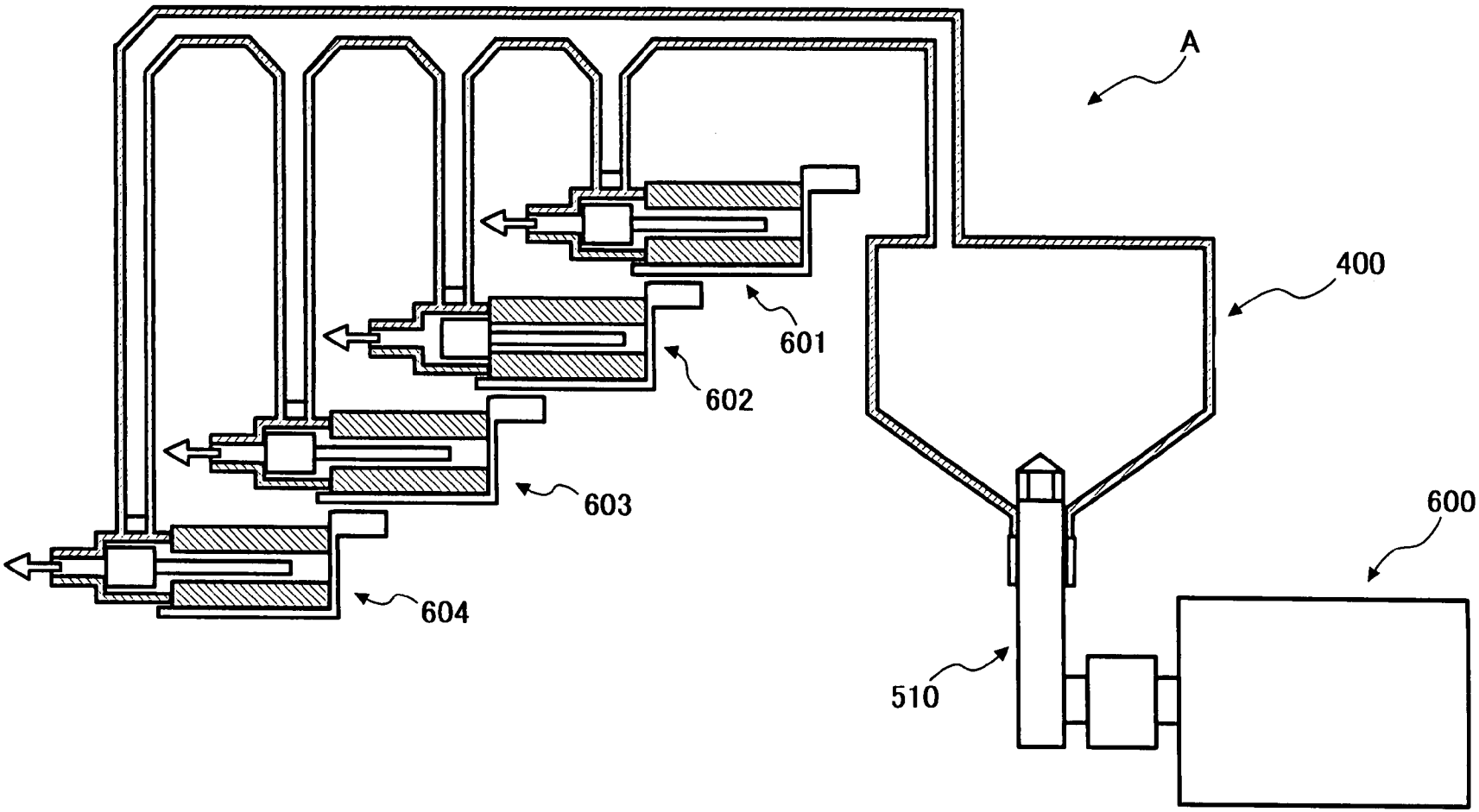
FIG. 6 is a view showing another specific configuration of the toner agitating device.

FIG. 6 shows air feeding means included in a color image forming apparatus to which the toner agitating device A and toner conveying device B of the illustrative embodiment are applied. The color image forming apparatus includes a plurality of developing devices and a plurality of toner containers corresponding one-to-one to each other, although not shown specifically. As shown in FIG. 6, air output from a single air feeding means 600 is delivered to each toner container via particular one of electromagnetic valves 601 through 604, which are identical in configuration with each other. The actual duration of air feed to each toner container should preferably be 5 seconds or less at most. In the configuration of FIG. 6, a single air feeding means 600 suffices despite that toners of a plurality of colors, i.e., four colors are used.

The air feeding means 600 may be implemented as a variable air pump whose output is variable. Alternatively, use may be made of a plurality of air feeding means 600 the number of which may not be the same as the number of developing devices, in which case each air feeding means 600 will be configured to produce a particular output; for example, the outputs of the air feeding means 600 will be varied stepwise. By driving one or more or all of such air feeding means 600, it is possible to implement a desired output and therefore to feed air in an amount matching with the amount of toner remaining in the individual toner container.

As stated above, the toner agitating device A, using a pump or air feeding means capable of varying the flow rate of air for a unit period of time, can feed an amount of air matching with the amount of toner remaining in a toner container, which may be soft or hard. This successfully prevents toner from remaining in a toner container due to short agitation when the amount of such toner is great or obviates short toner replenishment due to excessive air feed when the above amount is small.

The variable air pump is so configured as to vary the flow rate of air in a plurality of steps in accordance with the amount of toner remaining in a toner container, which is determined by residual amount sensing means by real-time measurement. For this purpose, a voltage to be applied to a motor, which drives the air pump, may be varied to control the flow rate of air. If desired, a plurality of such variable air pumps may be arranged and driven either selectively or at the same time.

The toner agitating device A may include a plurality of air pumps or air feeding means unable to vary their outputs, in which case each air pump will be provided with a particular flow rate. In this condition, by driving one or more or all of the air pumps at a time, it is possible to establish a desired flow rate. For example, in an air feeding system using two or more, e.g., three air feeding means, one or two or all of the three air pumps maybe driven at a time to thereby vary the flow rate of air, as desired.

The toner conveying device B is feasible for a color image forming apparatus or similar image forming apparatus of the type including a plurality of developing devices. For example, assume a color image forming apparatus including four developing devices and replenishing toner of particular color to each of the developing devices from one of four toner containers. It has been customary with this type of apparatus to feed air from a single air pump to any one of the toner containers by switching a valve. However, it is difficult to feed air to the individual toner container at adequate timing when two or more toner containers need air feed at the same time. By contrast, when two or more air pumps are used, air can be fed to the individual toner container at adequate timing and can be fed in an amount matching with the amount of toner remaining in the toner container.

With the construction described above, the illustrative embodiment allows highly fluid toner, which is optimally agitated in accordance with the amount of toner remaining in a toner container, to be efficiently conveyed to the developing device by the powder pump.

Air agitation and toner suction are closely related to the fluidity of toner; in an air agitation, powder pump toner conveyance system, the higher the fluidity, the easier the conveyance. This is because toner with high fluidity can be agitated by a small amount of air and can be conveyed by low suction pressure. Fluidity is, in turn, closely related to the shape of toner grains; the more spherical the toner grains, i.e., the higher the circularity as measured by FPIA (Flow type Particle Image Analyzer), the lower the resistance acting between toner grains and therefore the higher the fluidity. Fluidity is noticeably effected by the shape of toner grains as well as by the kind of an additive, e.g., silicon, so that spherical toner grains are extremely feasible for air agitation and powder pump toner conveyance.

In light of the above, in the toner agitating device A and toner conveying device B, use is made of toner whose circularity lies in the range of from 0.96 to 1, as measured by FPIA, which is considered to realize high fluidity.

If desired, a volatile memory, not shown, may be mounted to the toner container 400, so that data representative of the total amount of toner conveyed by the toner conveying device can be written to the volatile memory. Stated another way, the above data is representative of the level of the amount of toner remaining in the toner container 400. A controller, not shown, uses such data to control air feed. More specifically, the data is written to the volatile memory as real-time information and is read out for air feed control. This insures adequate air feed control even when the toner container 400 is dismounted from the apparatus body, e.g., the holder 500 and again mounted thereto.

By applying the toner agitating device A and toner conveying device B described above to the image forming section of a copier, printer, facsimile apparatus or similar electrophotographic image forming apparatus, it is possible to enhance the agitation and conveyance of toner and therefore to insure stable toner replenishment without regard to the amount of remaining toner. It is to be noted that the image forming section mentioned above includes a photoconductive element, a charger, an exposing device, a developing device, an image transferring device and a fixing unit.

In summary, it will be seen that the present invention provides a toner agitating device and a toner conveying device for an image forming apparatus having various unprecedented advantages, as enumerated below.

(1) The toner agitating device can feed air from air feeding means to powdery toner stored in a toner container formed of a soft material and in which agitating means and discharging means cannot be arranged, thereby agitating and fluidizing the toner.

(2) The toner conveying device can efficiently convey the toner, which is agitated by the toner agitating device, with a powder pump in accordance with the amount of toner remaining in the toner container.

(3) There can be implemented an electrophotographic image forming apparatus in which the toner conveying device replenishes the toner to a developing device.

(4) Use is made of an air pump capable of varying the flow rate of air stepwise in accordance with the amount of remaining toner. It is therefore possible to obviate defective conveyance ascribable to defective agitation when the amount of remaining toner is great or to obviate the degradation of image quality ascribable to short conveyance when the amount of remaining toner is small.

(5) By combining a plurality of non-variable air pumps, it is possible to adequately, precisely controlling the amount of air in matching relation to the amount of remaining toner.

(6) Means for conveying the toner to the developing device is implemented by a powder pump that is small size, but can efficiently convey toner, so that a flexible tube can be used as means for connecting the toner container and the developing device. This not only promotes free layout, but also allows a minimum of toner to remain in the tube.

(7) Data representative of the amount of remaining toner, which is produced from the amount of toner conveyed, is written to a volatile memory mounted on the toner container and used for air feed control. Therefore, even when the toner container is dismounted from the apparatus body and again mounted thereto, adequate air feed control can be executed.

(8) Toner grains are substantially spherical, so that resistance between the toner grains is low, i.e., fluidity is high.

(9) Toner conveyance with the above advantages is attainable and enhances image quality.

Various modifications will become possible for those skilled in the art after receiving the teachings of the present disclosure without departing from the scope thereof.

What is claimed is:

1. In a toner agitating device for feeding air from air feeding means to an inside of a toner container storing powdery toner to thereby agitate said powdery toner, said air feeding means comprises at least one variable air pump capable of varying an amount of air to be fed for a unit time based on an amount of toner in the toner container.

2. The device as claimed in claim 1, wherein the toner has circularity of 0.96 to 1 as measured by FPIA.

3. In a toner agitating device for feeding air from air feeding means to an inside of a toner container storing powdery toner to thereby agitate said powdery toner, said air feeding means comprises a plurality of air pumps unable to vary an amount of air to be fed for a unit time and each being provided with a particular flow rate.

4. The device as claimed in claim 3, wherein the toner has circularity of 0.96 to 1 as measured by FPIA.

5. A toner conveying device comprising:

a toner agitating device configured to feed air from air feeding means to an inside of a toner container storing powdery toner to thereby agitate said powdery toner; and a pump configured to suck the toner from the toner container, which is agitated by said toner agitating device, to thereby convey said toner to an outside of said toner container;

wherein said air feeding means comprises at least one variable air pump capable of varying an amount of air to be fed for a unit time based on an amount of toner in the toner container.

6. The device as claimed in claim 5, wherein a volatile memory, allowing data representative of an amount of the toner conveyed by said device to be written thereto, is mounted on the toner container, which is removable.

7. The device as claimed in claim 5, wherein the toner has circularity of 0.96 to 1 as measured by FPIA.

8. A toner conveying device comprising:

a toner agitating device configured to feed air from air feeding means to an inside of a toner container storing powdery toner to thereby agitate said powdery toner; and a pump configured to suck the toner from the toner container, which is agitated by said toner agitating device, to thereby convey said toner to an outside of said toner container;

wherein said air feeding means comprises a plurality of air pumps unable to vary an amount of air to be fed for a unit time and each being configured to feed air at a particular flow rate.

9. The device as claimed in claim 8, wherein a volatile memory, allowing data representative of an amount of the toner conveyed by said device to be written thereto, is mounted on the toner container, which is removable.

10. The device as claimed in claim 8, wherein the toner has circularity of 0.96 to 1 as measured by FPIA.

11. An electrophotographic image forming apparatus comprising:

a toner conveying device comprising a toner agitating device configured to feed air from air feeding means to an inside of a toner container storing powdery toner to thereby agitate said powdery toner, and a power pump configured to suck said powdery toner from said toner container, which is agitated by said toner agitating device, to thereby convey said powdery toner to an outside of said toner container, said air feeding means comprising at least one variable air pump capable of varying an amount of air to be fed for a unit time based on an amount of toner in the toner container; and an image forming section including a developing device configured to receive the toner conveyed by said toner conveying device.

12. An electrophotographic image forming apparatus comprising:

a toner conveying device including a toner agitating device configured to feed air from air feeding means to an inside of a toner container storing powdery toner to thereby agitate said powdery toner, and a pump configured to suck said powdery toner from said toner container, which is agitated by said toner agitating device, to thereby convey said powdery toner to an outside of said toner container, said air feeding means comprising a plurality of air pumps unable to vary an amount of air to be fed for a unit time and each being configured to feed air at a particular flow rate; and an image forming section including a developing device configured to receive the toner conveyed by said toner conveying device.

* * * * *